United States Patent [19]

Chen

[11] 4,428,814

[45] Jan. 31, 1984

[54] ELECTROPLATING APPARATUS WITH CONSTANT VELOCITY AGITATION

[75] Inventor: Tsu-Fang Chen, Dresher, Pa.

[73] Assignee: Sperry Corporation, New York, N.Y.

[21] Appl. No.: 411,400

[22] Filed: Aug. 25, 1982

[51] Int. Cl.[3] ..... C25B 15/02; C25C 7/06

[52] U.S. Cl. ..... 204/273; 204/261; 204/307; 366/296; 366/271; 366/300; 366/257; 366/293

[58] Field of Search ..... 366/49, 271, 300; 204/261, 273, 307; 366/257, 293, 296, 297

[56] References Cited

U.S. PATENT DOCUMENTS 568,099 9/1889 Pelatan et al. ..... 204/273
2,778,614 1/1957 Koch ..... 259/132

FOREIGN PATENT DOCUMENTS 1238075 10/1959 France ..... 366/296

*Primary Examiner*—T. Tung
*Assistant Examiner*—Nathan S. Thane
*Attorney, Agent, or Firm*—James R. Bell; Marshall M. Truex

[57] ABSTRACT

Apparatus is disclosed, for mechanically agitating, in a non-reciprocating manner, a permalloy composition used in an electroplating procedure, in such a way as to apply a film of improved uniformity of composition and thickness thus avoiding limitations of prior electroplating processes which, due to uneven boundary layer flow patterns caused by reciprocating agitation, result in non-uniformities in film composition and thickness.

7 Claims, 9 Drawing Figures

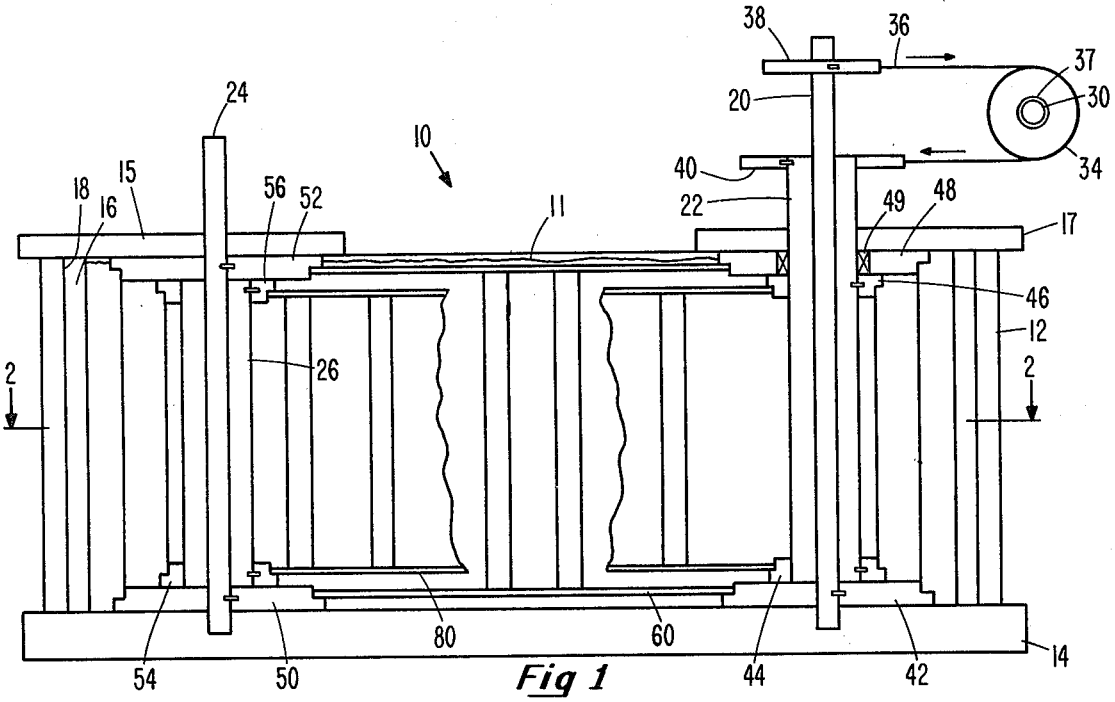
Fig 1
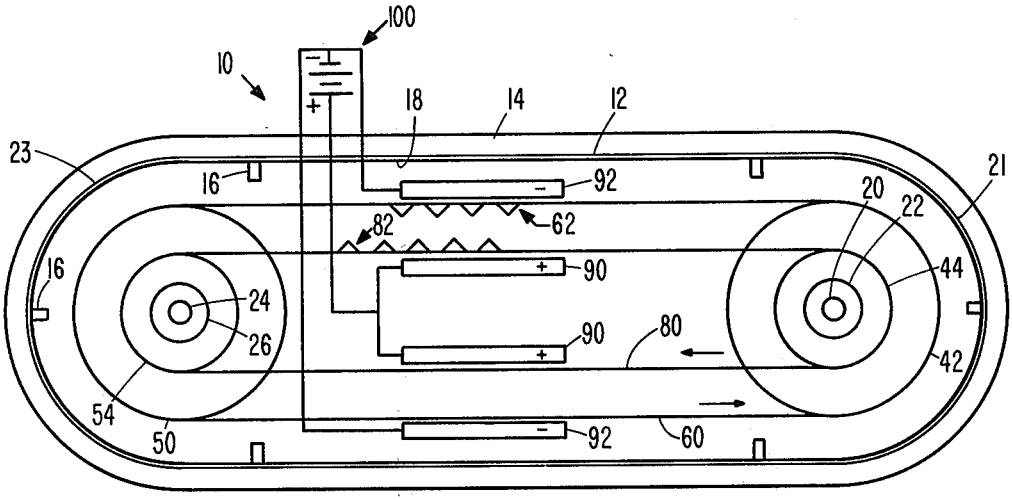
Fig 2
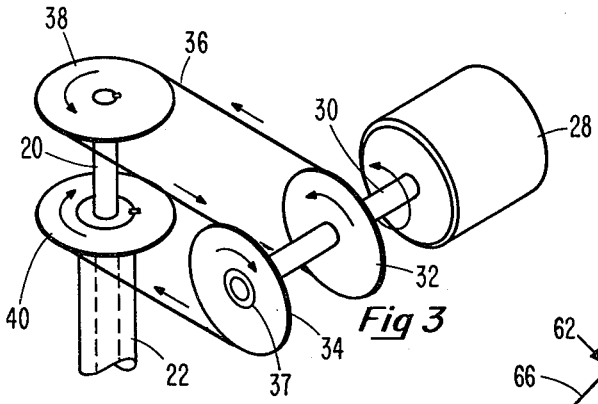
Fig 3
Fig 4
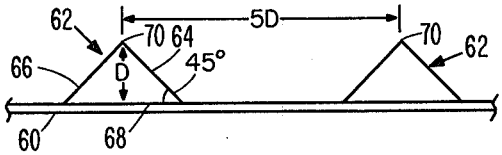

ELECTROPLATING APPARATUS WITH CONSTANT VELOCITY AGITATION

BACKGROUND OF THE INVENTION

1. Field of the Invention

This invention relates generally to electrical and wave energy chemistry for electroforming alloys from an aqueous bath and more particularly to electroplating a substrate with a permalloy composition to form a thin film on a magnetic recording head.

2. Description of the Prior Art

When a mechanical member is used to agitate an electroplating solution by reciprocating motion, the velocity of that member ranges from 0, at each end of the stroke, to a maximum or peak velocity which is reached between the ends of the stroke. Such changes in the velocity cause uneven boundary layer flow patterns which can result in intolerable non-uniformities in film composition and thickness. This is especially limiting where uniformity is critical as in magnetic recording-head, thin-film electroplating using a permalloy composition. As an example, such thin films can have a thickness of 2 microns and can tolerate a variance of only ±0.06 microns.

Both vertical and horizontal plating cells have been used. Of the two, vertical cells are preferred due to easier access to the plated substrates. However, previously known reciprocating agitation, even in vertical cells, is limited in the ability to provide the necessary uniformity required for applying a satisfactory electroplated thin film to a substrate for magnetic recording head production.

Even the continuous flow or flushing of electroplating composition forced across a stationary substrate, in lieu of mechanical agitation, causes uneven boundary layer flow patterns to form thus causing non-uniform films.

The foregoing illustrates limitations of the known prior art. Thus, it is apparent that it would be advantageous to provide an alternative directed to overcoming one or more of the limitations as set forth above. Accordingly, a suitable alternative is provided including features more fully disclosed hereinafter.

SUMMARY OF THE INVENTION

In one aspect of the present invention, this is accomplished by providing an electroplating apparatus including a reservoir including an anode and a cathode mounted therein. Fluid may be agitated within the reservoir by first and second endless belts. The first belt has paddles mounted thereon and is operably connected for movement at a constant velocity in a first direction adjacent the anode. The second belt also has paddles mounted thereon and is operably connected for movement at a constant velocity in a second direction, opposite the first direction, adjacent the cathode.

The foregoing and other aspects will become apparent from the following detailed description of the invention when considered in conjunction with the accompanying drawings. It is to be expressly understood, however, that the drawings are not intended as a definition of the invention but are for the purpose of illustration only.

BRIEF DESCRIPTION OF THE DRAWINGS

In the drawings:

FIG. 1 is a diagrammatic cross-sectional side view illustrating an embodiment of the electroplating apparatus of this invention;

FIG. 2 is a diagrammatic planar view taken along the line 2—2 of FIG. 1;

FIG. 3 is an isometric view illustrating an embodiment of a part of this invention for driving counter-rotating members;

FIG. 4 is a diagrammatic view illustrating an embodiment of the paddles of this invention;

FIGS. *7a* and *7b* are graphic views illustrating uniform and non-uniform boundary layer flow patterns.

DESCRIPTION OF THE PREFERRED EMBODIMENT

Figure 7B:
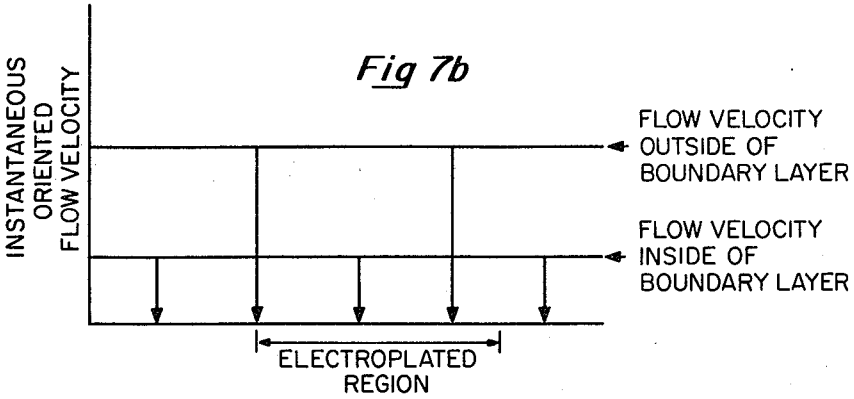

A reservoir, diagrammatically illustrated in FIGS. 1 and 2, and generally designated 10, contains an electroplating permalloy fluid 11 comprising about 80% $Ni^{++}$ and about 20% $Fe^{++}$. Reservoir 10 and most components thereof exposed to the permalloy are formed of a suitable non-metallic material such as, for example, nylon. An oval, vertical sidewall 12 and planar horizontal base 14 of reservoir 10 are connected in a fluid tight manner. A plurality of elongated vertical baffles 16, of reservoir 10, are connected to a surface 18 of sidewall 12. A first and second pair of concentric shafts 20, 22 and 24, 26, respectively are vertically mounted in spaced relationship within reservoir 10 in such a manner so as to permit rotation of the shafts relative to reservoir 10 and relative to each other. For example, opposite ends of shafts 20, 22, 24, 26 can be retained in position by base 14 and by plates 15, 17. Shafts 20 and 24 are smaller in diameter than shafts 22 and 26. Also, shafts 20 and 24 are mounted concentrically within shafts 22, 26, respectively. A pair of opposed curved ends 21, 23 of sidewall 12 are concentric with shafts 20, 22, 24, 26.

Means are available for counter-rotating shafts 20, 22, 24, 26. Such means, for example, may include a readily available small or fractional horsepower electric motor 28 having a shaft 30 and a pair of sprockets 32 and 34 mounted thereon. Sprocket 32 is fixed to rotate with shaft 30 and driver 34 is bearing mounted at 37 to freely rotate on shaft 30. A notched endless drive belt 36 engages sprockets 32, 34 and is thus driven thereby.

Shaft 20 includes a fixed sprocket 38 engaged by belt 36. Also, shaft 22 includes a fixed sprocket 40 engaged by belt 36. In this manner, for example when shaft 30 is rotated, belt 36 is driven by sprocket 32 and rotates sprocket 38 and shaft 20 in a first direction. Subsequently, belt 36 engages sprocket 34 and rotates sprocket 40 and shaft 22 in a second direction opposite the first direction. Belt 36 then returns to sprocket 32 (see also FIG. 3).

Shaft 20 includes a fixed sprocket 42 adjacent base 14. Shaft 22 includes a fixed sprocket 44 adjacent base 14 and another fixed sprocket 46 adjacent plate 17. Another sprocket 48 is bearing mounted at 49 on shaft 22 adjacent plate 17.

Shaft 24 includes a fixed sprocket 50 adjacent base 14 and another fixed sprocket 52 adjacent plate 15. Shaft 26 includes a fixed sprocket 54 adjacent base 14 and another fixed sprocket 56 adjacent plate 15.

A first or outer endless belt 60 engages sprockets 42, 48, 50, 52. Belt 60 is driven via sprocket 42 on shaft 20 and belt 60 drives sprockets 50, 52 on shaft 24. Belt 60 includes a plurality of paddles 62 having a generally triangular cross-section (see FIG. 4) including sides 64, 66 disposed at about a 45° angle relative to base side 68. A characteristic distance "D" between side 68 and an apex 70 is preferably from about $\frac{1}{8}''$ to about $\frac{1}{4}''$ in length. The center-to-center distance between apexes 70 of adjacent paddles 62 is preferably about 5 D.

A second inner endless belt 80 engages sprockets 44, 46, 54, 56. Belt 80 is driven via sprockets 44, 46 on shaft 22 and belt 80 drives sprockets 54, 56 on shaft 26. A plurality of paddles 82 on belt 80 meet the above-described parameters for paddles 62. However, paddles 62 and 82 have apexes which extend toward each other as is best illustrated in FIG. 2. Due to the concentricities of oppositely driven shafts 20, 22, 24, 26 and the sizes of associated sprockets 42, 48, 50, 52, 44, 46, 54, 56, outer belt 60 and inner belt 80 continuously move in opposite directions maintaining substantially even spacing therebetween throughout their movement.

Figure 5:
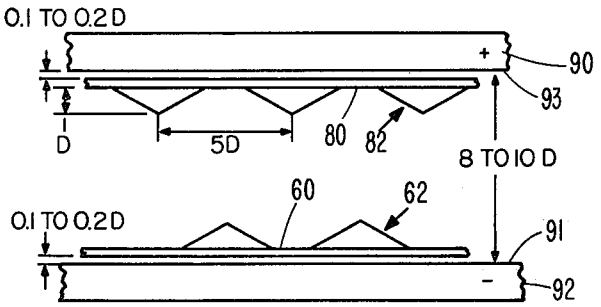
FIG. 5 is a diagrammatic view illustrating an embodiment of preferred relationships between paddles, an anode and a cathode of this invention.

At least one exemplary anode 90, and preferably two, are mounted in the reservoir 10 submersed in permalloy fluid 11. Anodes 90 are positioned along the path of travel of belt 80. A substrate (cathode) 92 is positioned in reservoir 10 submersed in fluid 11 along the path of travel of belt 60 so that each substrate 92 is opposite an associated anode 90. It is to be understood that the number of anodes 90 and opposed substrates 92 may vary. An exemplary electrical power source 100 operably interconnects anodes 90 and substrates 92 thus establishing the desired electrical potential between an anode 90 and a substrate 92 to be electroplated for the purpose of establishing electromotive flow electrically urging permalloy molecules toward substrates 92. The desired plating period of electroplating substrate 92 is from about 2 minutes to about 30 minutes. In FIG. 5 it is further illustrated that the preferred distance between belt 60 and a respective surface 91 of substrate 92 is from about 0.1 D to about 0.2 D. Also the preferred distance between surface 91 of substrate 92 and surface 93 of anode 90 is from about 8 D to about 10 D.

Figure 6:
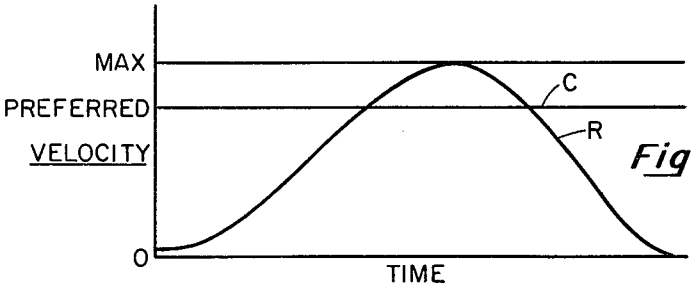
FIG. 6 is a graphic view illustrating a comparison of reciprocating paddle velocities and the non-reciprocating paddle velocities of this invention.

Over-agitation of electroplating fluids such as 80–20 NiFe is not beneficial because the fluid in the immediate vicinity of surface 91 of substrate 92 can become iron rich. Therefore, the paddle velocity is preferably about 20 cm/sec. and should not exceed 50 cm/sec. Thus, it becomes apparent that agitating the fluid will properly improve the uniformity of Ni and Fe molecular distribution throughout the fluid. However, agitation transforms a fluid from a laminar state to a turbulent state as in the exemplary case of an airfoil moving through the air. It is well known that when there is relative movement between air and an airfoil, air preceding the leading edge of the airfoil is in a laminar state and that air immediately following the trailing edge of the airfoil is in a turbulent state. However, that turbulent state eventually again becomes laminar as a function of distance following the trailing edge. The foregoing holds for disturbance of any fluid where there is relative movement between the fluid and an object causing the disturbance. In the case of reciprocating agitation, the velocity of the reciprocating member varies between 0, at the end of each stroke, to a peak or maximum velocity between the ends of the stroke, as illustrated by line "R" on the graph of FIG. 6. On the other hand, a desired velocity of an agitating member can be maintained constant as illustrated by line "C" on the graph of FIG. 6.

Figure 7A:
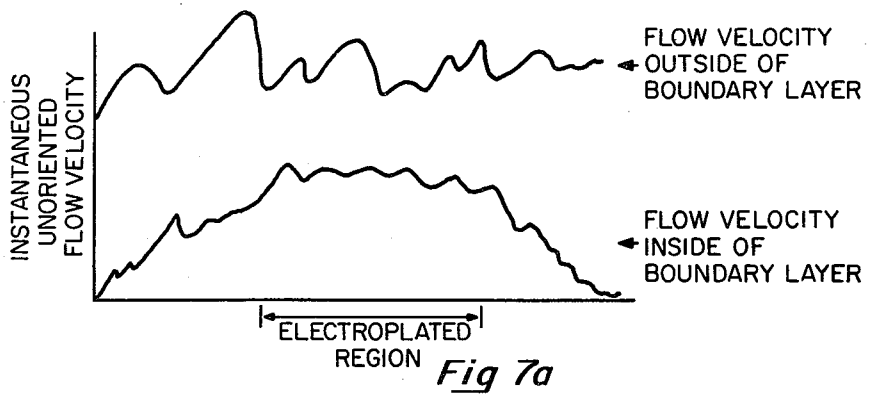

Ideally, during an electroplating process, boundary layer flow patterns should remain constant as graphically indicated in FIG. 7*b*. However, some agitation processes, such as the aforementioned reciprocating or flushing processes can cause uneven boundary layer flow patterns causing non-uniformities in film composition and thickness, see in FIG. 7*a*.

The present invention provides first belt 60 and paddles 62 spaced apart at a predetermined distance and moving at a constant velocity in a first direction combined with a second belt 80 having paddles 82 also spaced at the predetermined distance and moving at a constant velocity in a second direction, opposite the first direction.

As it is well known, the paddles 62, 82, moving through fluid 11 cause a desired vortex 99 in the fluid. Advantageously, the spacing of each of the paddles 62, and each of the paddles 82 maintain the desired chain or series of substantially similar vorticies in a constant manner.

Figure 8:
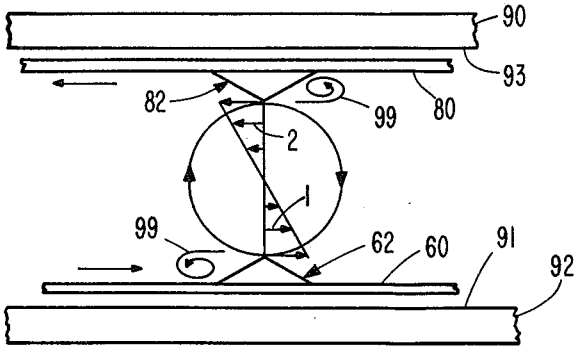
FIG. 8 is a graphic view illustrating an orderly agitation of the solution without excessive turbulence accomplished by this invention.

FIG. 8 graphically illustrates by the decreasing size of the arrows designated 1, that the magnitude of the solution flow velocity created by constantly moving paddles 62 dissipates as a function of distance in a direction away from substrate 92. However, as the direction of arrows 1 indicate, constant movement of paddles 62 in a first direction could cause a swirling or whirlpool effect of fluid 11 within reservoir 10. To counteract this effect, paddles 82 move in a second direction opposite to the first direction to "cancel out" or "neutralize" such fluid motion. Arrows of decreasing size, designated 2, illustrate that the magnitude of the velocity created by oppositely constantly moving paddles 82 similarly dissipates as a function of distance in a direction away from anode 90. In addition, baffles 16, FIGS. 1 and 2, assist in diminishing any undesired swirling motion of fluid 11 in reservoir 10.

If desired, belts 60 and 80 can be sequentially reversed in alternate directions. If so, it is recommended that such reversal should be induced every $\frac{1}{4}$ of the plating period, and, as mentioned previously, the preferred plating period is from about 2 minutes to about 30 minutes.

In reservoir 10, a Reynolds number less than 2000 provides laminar flow of fluid 11 and a Reynolds number greater than 2000 provides turbulent flow. The Reynolds number is calculated by V D divided by $\nu$, where V is the paddle velocity, D is the previously given paddle dimension, and $\nu$ is the viscosity of fluid 11.

The foregoing has described an electroplating apparatus with constant velocity agitation including first and second, constant velocity, counter-rotating endless agitator belts which simultaneously accomplish a desired constant agitation of electroplating fluid in the vicinity of a cathode substrate while neutralizing any tendency of the fluid to exhibit a "swirling" or "whirlpooling" motion within the reservoir of the apparatus.

It is anticipated that aspects of the present invention, other than those specifically defined in the appended claims, can be obtained from the foregoing description and the drawings.

Having thus described the invention, what is claimed is:

1. Electroplating apparatus with constant velocity agitation comprising:

a reservoir;

at least one anode in said reservoir;

at least one cathode in said reservoir;

first means for agitating a fluid in said reservoir, said means including an endless first belt having a plurality of paddles on a first surface thereof, said first belt operably connected for movement at a constant velocity in a first direction and having a second surface adjacent said anode;

second means for agitating a fluid in said reservoir, said means including an endless second belt having a plurality of paddles on a first surface thereof opposite said first belt paddles, said second belt operably connected for movement at a constant velocity in a second direction, opposite said first direction, and having a second surface adjacent said cathode; and said reservoir including a sidewall having a plurality of baffles connected thereto.

2. The apparatus of claim 1 wherein said belts are driven by pairs of concentric shafts.

3. The apparatus of claim 2 wherein said sidewall includes curved endwalls, said endwalls being concentric with said shafts.

4. The apparatus of claim 2 including:

means connected to said shafts for counter-rotating said belts.

5. The apparatus of claim 1 wherein said paddles include a triangular cross-section having two sides disposed at about 45° with a third side, said triangle including a distance D between a base and an apex thereof, the distance between apexes of adjacent paddles being about 5 D, the distance between said anode and an opposite cathode is from about 8 D to about 10 D, the distance between said first belt and said anode is from about 0.1 D to about 0.2 D and the distance between said second belt and said cathode is from about 0.1 D to about 0.2 D.

6. The apparatus of claim 4 wherein said belts are provided to move at a velocity of about 20 cm/sec and said distance D is from about $\frac{1}{8}$ inches to about $\frac{1}{4}$ inches.

7. The apparatus of claim 1 including:

means connected for providing electrical power between said anode and cathode.

* * * * *